United States Patent [19]

Courvoisier et al.

[11] 4,433,494

[45] Feb. 28, 1984

[54] ARTICLE OF CLOTHING OR ACCESSORY INTENDED TO ADAPT ITSELF CLOSELY TO A PART OF THE HUMAN BODY AND A PROCESS FOR ADAPTING THIS ARTICLE OR ACCESSORY TO THIS PART OF THE HUMAN BODY

[75] Inventors: Guy Courvoisier; Simon Arieh, both of Geneva, Switzerland

[73] Assignee: Lange International S.A., Fribourg, Switzerland

[21] Appl. No.: 177,765

[22] PCT Filed: Mar. 29, 1979

[86] PCT No.: PCT/CH79/00047

§ 371 Date: Dec. 6, 1979

§ 102(e) Date: Dec. 4, 1979

[87] PCT Pub. No.: WO79/00886

PCT Pub. Date: Nov. 1, 1979

[30] Foreign Application Priority Data

Apr. 6, 1978 [CH] Switzerland ..... 3695/78

[51] Int. Cl.[3] ..... A43B 5/04; A42B 3/00

[52] U.S. Cl. ..... 36/119; 36/93; 2/420

[58] Field of Search ..... 36/93, 71, 98, 87, 119, 36/88, 117; 2/412, 417, 420, 414; 264/222, 299, 319, 313, DIG. 30; 12/142 P, 142 R

[56] References Cited

U.S. PATENT DOCUMENTS

| | | | |
|---|---|---|---|
| 3,613,271 | 10/1971 | Geller | 36/119 |
| 3,641,688 | 2/1972 | Benken | 36/88 X |
| 3,760,056 | 9/1973 | Rudy | 36/93 X |
| 3,818,508 | 6/1974 | Lammers et al. | 2/412 |
| 3,848,287 | 11/1974 | Simonsen | 36/88 X |
| 3,977,034 | 8/1976 | Brown | 12/142 R |
| 4,108,928 | 8/1978 | Swan, Jr. | 36/93 X |

*Primary Examiner*—Peter P. Nerbun

*Attorney, Agent, or Firm*—Karl F. Ross; Herbert Dubno

[57] ABSTRACT

The invention relates to a padding allowing an article of clothing or an accessory to be adapted closely to a part of the human body.

This padding is constituted by a thermo-formable plastic foam 2 placed in a non-extensible covering 1 and making an open cavity intended to receive the part of the body, but of which the dimensions are generally smaller than this part of the body. The housing is thus formed by the reciprocal compression of the foam and of the part of the body placed in the cavity while the temperature of the foam is brought to the thermo-forming temperature.

This invention can be used for adapting boots, helmets, gloves, swimming flippers, etc.

7 Claims, 7 Drawing Figures

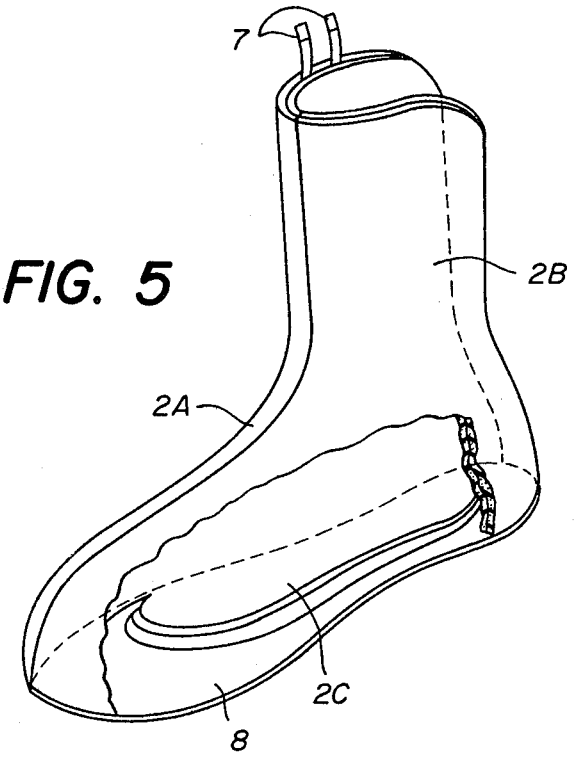
FIG. 5
FIG. 6
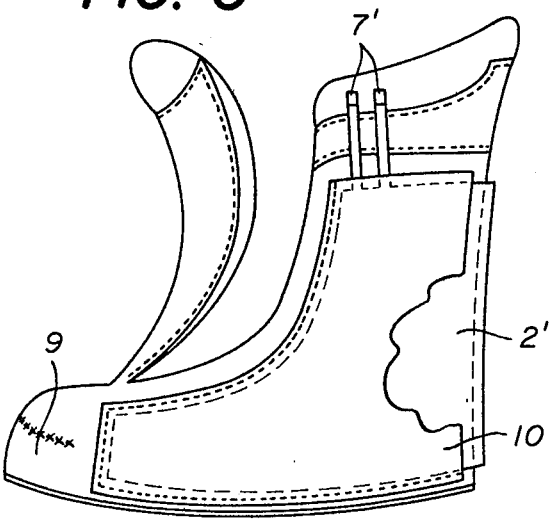
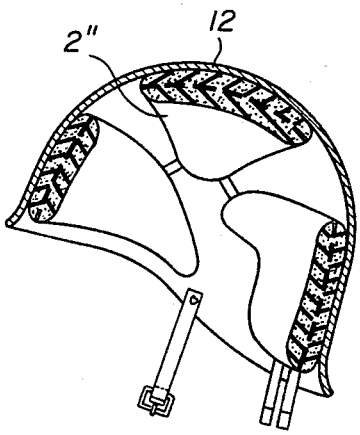
FIG. 7

ARTICLE OF CLOTHING OR ACCESSORY INTENDED TO ADAPT ITSELF CLOSELY TO A PART OF THE HUMAN BODY AND A PROCESS FOR ADAPTING THIS ARTICLE OR ACCESSORY TO THIS PART OF THE HUMAN BODY

CROSS REFERENCE TO RELATED APPLICATIONS

This application is a national phase application corresponding to PCT/CH79/00047 filed Mar. 29, 1979 and bsed upon Swiss national application 3695/78 filed Apr. 6, 1978 under the International Convention.

FIELD OF THE INVENTION

The invention relates to an article of clothing and, more particularly, to an article which can be adapted to the human body as an accessory for participation in various sports.

BACKGROUND OF THE INVENTION

There are several articles of clothing or accessories such as ski boats and helmets, fishing boots, boxing gloves, as well as swimming flippers which have to be adapted precisely to the parts of the body for which they are intended. The problem is further aggravated when the covering is rigid, as in the case of boots for downhill skiing, or helmets, because it is impossible in practice to mold a special covering adapted to the feet or to the head of each user. Now it is known that there are virtually never two individuals having the same morphology. This is why use is generally made of paddings made of deformable material in order to adapt the covering to the part of the body to be enclosed.

If the shoes are shaped from an entirely rigid shell, as are the majority of boots intended for downhill skiing the foot has to be held as closely as possible in the boot but still remain comfortable. Since the rigid shell is molded as a function of a given size and such a molding is inevitably standard, the boot is adapted to the foot by means of intermediate padding intended to match the shape of the foot as faithfully as possible.

Various solutions have already been proposed for forming this padding. Most of these techniques use a foamed plastic having the appearance of a sock placed in the rigid shell. This sock is shaped so as to reproduce the shape of the foot internally, fairly faithfully, and the foam allows it to be adapted to the slight morphological variations which exist between various feet of similar sizes. This solution is only partially satisfactory in so far as a standard sock is intended to adapt itself to feet of substantially the same size, that is to say the same length between the heel and the tip of the toe, but of which the configurations can, however, vary quite significantly among themselves. As a result, the foot is held fairly well but the comfort is uneven.

It has been proposed that this disadvantage be overcome by the in situ molding of expanded foam which is injected in a flexible chamber in the form of a sock, placed into the rigid shell and receiving the foot to which the boot is to be adjusted. The foam fills the free spaces between the foot and the shell, faithfully matching the shape of the foot. This is a solution which is capable of giving good results. Unfortunately, it is rather awkward to carry out the process, the foam is often distributed badly and the proportion of failures is high. It is also an expensive technique since each failure increases the price. Moreover this expanded foam does not have a very high resistance to fatigue and its density is fairly high. Although this solution was very successful initially, it has gradually been abandoned because of these factors.

It has also been proposed that cushions of wax or other similar materials be injected into certain regions to improve the retention of the foot in the shell. However, cushions of this type lack elasticity. It should also be noted that the present tendency is to produce light boots which have only a single fastener and not three or four, so that it is even more important to hold the foot in the shell as closely as possible, the gripping effect produced by fasteners being substantially reduced.

Use has already been made of thermo-formable foams produced from low density polyethylene which has been blown with nitrogen, in the medical sphere, particularly for hot-molding this foam around various parts of the body in order to produce cradles or orthopaedic supports or for adapting a prosthesis to a mutilated limb. The foam is heated to its thermo-forming temperature of about 140° C. and applied to the part of the body to which this foam is to be adapted, the foam being modeled until it matches the desired shape perfectly. Contrary to any possible fears, there is virtually no risk of burning. In fact, bearing in mind that the density of the material is of the order of 0.04, that this is a foam with a low specific heat containing a large amount of gas and that the thermal conductivity of polyethylene is poor and that of the foam is even poorer owing to the large volume of gas which it contains, the amount of calories to be dissipated per unit time and per unit surface area is perfectly compatible with the heat exchange tolerable by the skin due to the circulation of blood. It should also be added to these considerations that the surface area of material in direct contact with the skin is very small relative to the surface area of skin covered by the foam.

OBJECT OF THE INVENTION

The object of the present invention is to make use of of a foam of this type to overcome the disadvantages of the above-mentioned systems of adaptation so as to obtain an internal lining for the covering, whose shape results from the flow of the foam which is brought to its thermo-forming temperature and subjected to stress by compression until this stress disappears, which constitutes the final stage of adaptation of the covering to the foot part of the body.

SUMMARY OF THE INVENTION

For this purpose, the invention relates to an article of clothing or other accessory intended to be adapted closely to a part of the human body, comprising a non-extensible external covering and a flexible padding lining. This padding is composed of a thermo-formable plastic foam and is shaped so as to make, inside the said covering, an open cavity roughly of the shape of this part of the body, at least some of the dimensions of this cavity being smaller than the corresponding dimensions of this part of the body.

This invention also relates to a process for adapting the article of clothing or accessory to the said part of the human body of a given individual, characterised by the fact that the said foam and the said part of the body are subjected to reciprocal pressure by the introduction of the latter into the said cavity, while bringing the temperature of this foam to its thermo-forming temperature for a sufficiently long period to allow the said foam to flow until the substantial stresses exerted on the said part of the body disappear, the foam being then left to cool at least to its setting temperature.

Although a boot will be referred to specifically hereinafter, it must only be considered as an example of a covering and not as a limitation of the invention, which can be used directly for the adaptation of helmets, gloves, for example boxing gloves, fishing boots, socks for sub-aqua diving suits, swimming flippers etc.

BRIEF DESCRIPTION OF THE DRAWING

The attached drawing illustrates schematically and by way of example the invention as applied to a boot and a helmet. In the drawing:

FIG. 5 is a perspective view of the rough shape of the padding.

FIG. 6 is an elevation of a variation.

FIG. 7 is a sectional view of a helmet.

SPECIFIC DESCRIPTION

Figure 1:
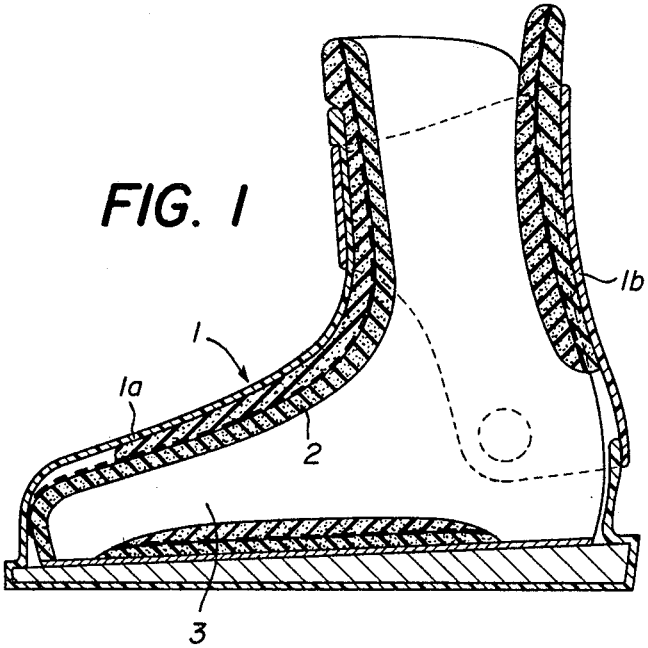
FIGS. 1 and 2 are sectional views of a boot, illustrating two phases of the invention.
Figure 2:
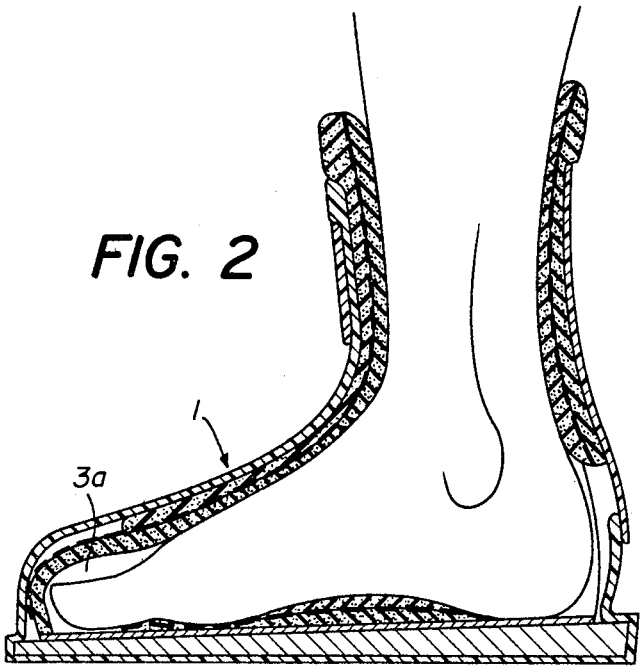

The embodiment illustrated in FIGS. 1 and 2 relates a boot, particularly a boot for downhill skiing comprising a shell 1 of molded plastic which is generally shaped from two parts 1*a*, 1*b* articulated to each other and fixed by one or more fasteners. These fasteners are not shown in the attached drawings as they are not essential to the understanding of the invention.

The interior of the shell 1 is covered with a padding of thermo-formable thermoplastic foam 2 which can advantageously have the form of a sock which is inserted into the shell and is therefore produced separately from it, making an internal cavity 3 generally of the shape of the body part to be received, i.e. a foot. This foam is preferably a low density polyethylene foam blown with nitrogen and marketed under the registered trade mark "Plastazote". This foam has been designed specifically for medical uses as its density of 0.04 and its low specific heat allow it to be placed in contact with the skin after having been heated to its thermo-forming temperature of about 120° to 140° C., without burning.

The sock formed by the padding 2 can preferably be made up in the form of a sandwich (FIG. 3) comprising two sheets of 6 mm thick foam 2*a* and 2*b*, each welded, for example, to each other, the polyethylene foam welding at its thermo-forming temperature. These sheets can also be sewn or stapled or rather fixed by any other suitable means. A network of electrical heating devices 4 constituted in this example by a copper deposition on a polyethylene substrate 5 is located between these foam sheets 2*a* and 2*b*. The network 4 is formed by the well known technique used for making up printed circuits and can cover a large proportion of the surface area of the sheet 5 (FIG. 4) so as to give good heat distribution.

Figure 4:
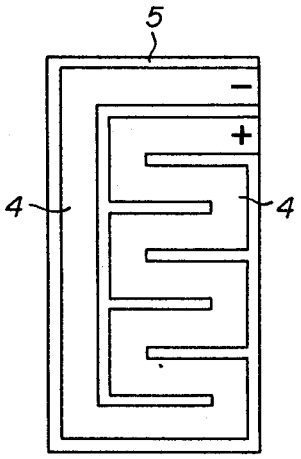
FIG. 4 is a view along line IV—IV in FIG. 3.

The sock can advantageously be produced in the manner illustrated in FIG. 5, that is to say with the aid of two sheets 2A and 2B of a sandwich which is similar to the one shown in FIG. 4 in which the networks of heating devices are incorporated. The combination of these sheets constitutes the vamp of the sock and one of them 2A has a supplement 2C which is folded back substantially at right-angles to form the support for the plantar arches. Depending on the quality of the sock, the padding 2 can be covered with a textile material 6*a*, 6*b* which either adheres or does not adhere to the padding 2. Connecting lugs 7 are also formed to allow the heating device to be connected to an electrical supply. An ordinary sole 8 can be joined to the sock 2.

The shape of the cavity 3 corresponds in a general manner to that of the foot to which the boot is to be adapted, but its dimensions are selected smaller than the corresponding dimensions of the foot.

However, the length of the cavity 3 preferably corresponds to the size of the foot for which the boot is intended to be adapted so as to avoid restricting the toes. On the other hand, it is advantageous to make a pocket 3*a* (FIG. 3) to allow the toes to move. Thus, it is the other dimensions of the cavity 3 which are undersized by approximately 1 to 2 sizes relative to the foot to which the boot is to be adapted. When the foot is introduced into the cavity 3, it is squeezed, with the exception of the toes, and by reaction, the same applies to the foam 2 which is trapped in the shell 1.

In order to adapt the boot, the foam 2 is then heated to its thermo-forming temperature which is from about 120° to 140° C. in this case. This heating can advantageously be carried out with the aid of the electric heating device 4 connected to a source of flow voltage current (not shown) provided with a time switch which is intended to cut the supply after a predetermined period selected so as to allow the padding 2 to be brought to its thermo-forming temperature. Of course, any other suitable heating system can be used. In such a case, the sock 2 could thus be produced with the aid of a single sheet without the incorporation of heating means. However, on a practical level, the solution illustrated is the one which is easiest to use and provides the best guarantee of success in carrying out the process since the electrical supply can be designed specifically for this purpose and even arranged so as to allow the power supply to be controlled as a function of the size of the sock.

Once the temperature of the foam forming the padding 2 corresponds to its flowing temperature, it gradually yields to the stress of the foot which thus finds room, the flow depending directly on the local stresses exerted by the foot of the foam. However, with the exception of certain zones of plantar support, the padding keeps the structure of the foam and its deformation is due only to the reaction of the foot resulting from the squeezing undergone during its introduction into the under-sized cavity 3. Moreover, the padding can be omitted in the most wanted zones of plantar support to leave only the sole 8.

Figure 3:
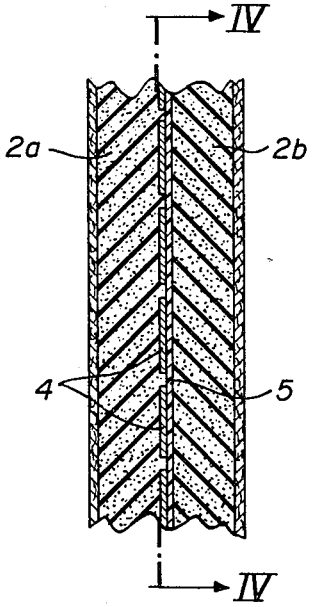
FIG. 3 is a enlarged sectional view of the flexible padding.

A few minutes are sufficient for the thermo-forming of the housing to its dimension adapted to the morphology of the foot introduced into the heated walls of foam. FIG. 3 shows that the pocket 3*a* which is provided so as to allow the toes to move remains after the formation of the housing. The boot is thus ready for immediate use.

Since the foam is a closed pore foam, openings can be made through the padding. The dimension of these openings as well as their distribution and density can be selected at random in order to assist the transfer of heat through the padding.

FIG. 6 illustrates a variation according to which a sock 9 formed from a material which is neither compressible nor thermo-formable has two lateral pockets, one 10 of which is shown in this figure while the other is arranged symmetrically about the longitudinal axis of the foot. These pockets are intended to receive the padding 2′ formed from a single part from an identical sandwich to that in FIG. 3. The two parts of this padding are threaded into the lateral pockets from the rear of the sock 9. The sock 9 is adapted in the same way as in the embodiment in FIGS. 1 to 5. The sock 9 provided with the padding 2′ is placed into a boot of corresponding size and the user whose foot corresponds to the size of this boot introduces his foot which is thus substantially squeezed in the region of the padding 2′. At this moment, the connecting lugs 7′ are connected to an electrical supply provided for this purpose (not shown), for example a 20 V supply of a suitable amperage to bring the temperature of the foam to between 120° and 140° C. without the sensation being intolerable, after which the supply is disconnected. The compressed foam at this temperature between the shell of the boot and the foot flows until the stresses exerted on the foot have practically disappeared. The adaptation is complete, and the housing thus formed is perfectly adapted to this foot which is thus held closely while still being perfectly comfortable, this being an important factor for the safety and comfort of the skier. The connecting lugs can obviously also be cut off later on.

FIG. 7 shows how this padding can be used for a helmet 12 in which are located cushions 2″, each formed by a sandwich which is similar to the one shown in FIG. 3, which are joined together by connections 11 so as to supply them with an electric current. The principle of adaptation is the same as for the boot, the thickness of the paddings 2″ is such that a certain stress is exerted on the heat to which the helmet 12 has to be adapted. The paddings 2″ are heated so as to cause the foam to flow under the influence of the stresses until they virtually disappear, after which the foam is left to cool, thus conserving the exact impression of the user's head.

One of the essential advantages of this method of adapting a covering round a part of the human body lies in the fact that the padding is closely adapted as a function of the local requirements demanded at the moment when it is heated to its thermo-forming temperature, and the fact that once it has cooled, it maintains its foam structure and consequently a certain flexibility which guarantees its comfort even after prolonged wearing of the boot or helmet. Moreover, the sandwich-type padding with the incorporated heating device is perfectly well adapted to widely distributed articles, and each retailer can receive a suitable supply set so that he can adapt the article to the user personally. Once the electrical connections have been removed, the user can no longer connect the heating device to an unsuitable source of supply.

We claim:

1. An article adapted to enclose a portion of a human body, comprising:

a shell of inextensible material;

a lining of a thermoformable plastic foam along the interior of said shell, surrounding said portion and defining in said shell a cavity having the shape of a portion of said body to be received in the shell but dimensioned so as to be placed under pressure upon the insertion of said portion of said body in said cavity by said body portion and the reaction of said shell, said lining being nonflowable but elastically deformable by said portion of said body unless heated independently of the heat of said body; and means in said articles for heating said lining to a temperature sufficient to cause said foam to flow under said pressure until the flow of the foam under the pressure of said body portion and the reaction of said shell terminates stresses from said pressure whereby said lining conforms to said portion of said body.

2. The article defined in claim 1 wherein said foam is composed of a low-density nitrogen-blown polyethylene having a density of substantially 0.04 and a thermoforming temperature of about 120° to 140° C.

3. A method of making an article adapted to a portion of the human body, comprising the steps of:

(a) inserting into a shell of inextensible material a lining of a thermoformable foam surrounded by said shell so as to define in said shell a cavity surrounding and having generally the shape of said portion of said body but dimensioned so as to be placed under pressure by said portion of said body with said lining pressing thereon; said lining being nonflowable but elastically deformable by said portion of said body unless heated independently of the heat of said body;

(b) inserting into said cavity said portion of said body so that said portion and said lining are under reciprocal pressure at least over part of said portion of said body;

(c) heating said lining in said article by heating means present therein to a thermoforming temperature tolerable by said portion of said body and for a period sufficient to cause said foam to flow until the stresses resulting from the reciprocal pressures are eliminated; and (d) permitting said foam to cool to a temperature below a thermoforming temperature, whereby said article is adapted to said portion of said body.

4. The method defined in claim 3 wherein said padding is heated to thermoforming temperature by passing an electric current through said lining to resistively heat the same directly within said shell.

5. The method defined in claim 4 wherein said shell forms a ski boot.

6. The method defined in claim 4 wherein said shell forms a helmet.

7. A ski boot comprising:

a shell of inextensible material and including a sole and an upper connected to said sole;

a sock adapted to receive the foot of a wearer and comprising a thermoformable foam adapted to line the interior of said shell and dimensioned so that said foam is placed under reciprocal pressure between opposing portions of said shell and said foot; and a resistance heater embedded in said sock and energizable to heat said foam to a thermoforming temperature tolerable by the wearer for a period sufficient to cause said foam to flow until the stresses resulting from the reciprocal pressures are eliminated.

* * * * *